US006913863B2

(12) United States Patent
Wu et al.

(10) Patent No.: US 6,913,863 B2
(45) **Date of Patent: *Jul. 5, 2005**

(54) PHOTOCONDUCTIVE IMAGING MEMBERS

(75) Inventors: Jin Wu, Webster, NY (US); Liang-Bih Lin, Webster, NY (US); Jennifer Y. Hwang, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 36 days.

This patent is subject to a terminal disclaimer.

(21) Appl. No.: 10/369,816

(22) Filed: Feb. 19, 2003

(65) Prior Publication Data

US 2004/0161684 A1 Aug. 19, 2004

(51) Int. Cl.[7] ..... G03G 5/14

(52) U.S. Cl. ..... 430/58.8; 430/131; 430/65; 430/59.4; 430/59.5; 430/126

(58) Field of Search ..... 430/58.8, 126, 430/59.5, 131, 64, 65, 59.4

(56) References Cited

U.S. PATENT DOCUMENTS

| | | | | |
|---|---|---|---|---|
| 4,265,990 A | | 5/1981 | Stolka et al. | 430/59 |
| 4,555,463 A | | 11/1985 | Hor et al. | 430/59 |
| 4,579,801 A | * | 4/1986 | Yashiki | 430/60 |
| 4,587,189 A | | 5/1986 | Hor et al. | 430/59 |
| 4,921,769 A | | 5/1990 | Yuh et al. | 430/64 |
| 5,473,064 A | | 12/1995 | Mayo et al. | 540/141 |
| 5,482,811 A | | 1/1996 | Keoshkerian et al. | 430/135 |
| 5,521,043 A | | 5/1996 | Listigovers et al. | 430/59 |
| 5,561,022 A | * | 10/1996 | Nogami et al. | 430/131 |
| 6,015,645 A | | 1/2000 | Murti et al. | 430/59 |
| 6,156,468 A | | 12/2000 | Wehelie et al. | 430/65 |
| 6,177,219 B1 | | 1/2001 | Yuh et al. | 430/65 |
| 6,255,027 B1 | | 7/2001 | Wehelie et al. | 430/65 |
| 6,287,737 B1 | | 9/2001 | Ong et al. | 430/58.8 |

FOREIGN PATENT DOCUMENTS

| | | | | |
|---|---|---|---|---|
| JP | 63284560 A | * | 11/1988 | G03G/5/14 |

OTHER PUBLICATIONS

Diamond, Arthur S. et al. (ed.) Handbook of Imaging Materials, 2nd edition. New York: Marcel–Dekker, Inc. (2002) pp. 174–176.*

* cited by examiner

*Primary Examiner*—Christopher Rodee
(74) *Attorney, Agent, or Firm*—E. O. Palazzo

(57) ABSTRACT

A photoconductive imaging member including a hole blocking layer, a photogenerating layer, and a charge transport layer, and wherein the hole blocking layer contains, for example, a metal oxide; and a mixture of a phenolic compound and a phenolic resin, and wherein the phenolic compound can contain at least two phenolic groups.

30 Claims, No Drawings

PHOTOCONDUCTIVE IMAGING MEMBERS

CROSS REFERENCE

There is illustrated in copending U.S. Ser. No. 10/370,186, entitled Photoconductive Imaging Members, filed concurrently herewith, now Publication No. 20040161683, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

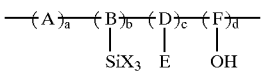

(I)

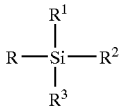

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

The appropriate components and processes of the above patents may be selected for the present invention in embodiments thereof.

BACKGROUND

This invention is generally directed to imaging members, and more specifically, the present invention is directed to single and multi-layered photoconductive imaging members with a hole blocking, or undercoat layer (UCL) comprised of, for example, a metal oxide, such as titanium oxide dispersed in a phenolic resin/phenolic resin blend or a phenolic resin/phenolic compound blend, and which layer can be deposited on a supporting substrate. More specifically, the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, azo pigments, squaraines, and the like. The imaging members of the present invention in embodiments exhibit excellent cyclic/environmental stability, and substantially no adverse changes in their performance over extended time periods since, for example, the imaging members comprise a mechanically robust and solvent resistant hole blocking layer, enabling the coating of a subsequent photogenerating layer thereon without structural damage; low and excellent $V_{low}$, that is the surface potential of the imaging member subsequent to a certain light exposure, and which $V_{low}$ is about 20 to about 100 volts lower than, for example, a comparable hole blocking layer of a titanium oxide/phenol resin/silicon oxide dopant, and which blocking layer can be easily coated on the supporting substrate by various coating techniques of, for example, dip or slot-coating. The photoresponsive, or photoconductive imaging members can be negatively charged when the photogenerating layers are situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM, available from OxyChem Company.

SUMMARY

It is a feature of the present invention to provide imaging members with many of the advantages illustrated herein, such as a rapid curing of the hole blocking layer during device fabrication, for example of about equal to, or less than about 30 minutes, for example from about 12 to about 20 minutes, and which layer prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant hole blocking layers containing certain phenolic resin binders.

In a further feature of the present invention there are provided imaging members containing hole blocking polymer layers comprised of titanium oxide and a phenolic compound/phenolic resin blend, or a low molecular weight phenolic resin/phenolic resin blend and which phenolic compounds containing at least two, and more specifically two to ten phenolic groups or low molecular weight phenolic resins with a weight average molecular weight ranging from about 500 to about 2,000, can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$.

Moreover, in another feature of the present invention there is provided a hole blocking layer comprised of titanium oxide, a phenolic resin/phenolic compound(s) blend or phenolic resin(s)/phenolic resin blend comprised of a first linear, or a first nonlinear phenolic resin and a second phenolic resin or phenolic compounds containing at least about 2, such as about 2, about 2 to about 12, about 2 to about 10, about 3 to about 8, about 4 to about 7, and the like, phenolic groups, and which blocking layer is applied to a drum of, for example, aluminum and cured at a high temperature of, for example, from about 135° C. to about 165° C.

Illustrated herein is the use of phenolic compounds containing at least two, and more specifically, from about 2 to about 10, and yet more specifically, from about 4 to about 7 phenolic groups, such as bisphenol S, A, E, F, M, P, Z, hexafluorobisphenol A, resorcinol, hydroxyquinone, catechin, a lower molecular weight phenolic resin with a weight average molecular weight of from about 500 to about 2,000 blended with a phenolic resin containing phenolic groups, and wherein there results in a cured mixture about 95 to about 98 percent, or in embodiments up to 100 percent. The phenolic resins include formaldehyde polymers with phenol and/or cresol and/or p-tert-butylphenol and/or bisphenol A, such as VARCUM™ 29159 and 29112 (OxyChem Co.), DURITE™ P-97 (Borden Chemical) and AROFENE™ 986-Z1-50 (Ashland Chemical).

Aspects of the present invention relate to a photoconductive imaging member comprised of a supporting substrate, a hole blocking layer thereover, a photogenerating layer and a charge transport layer, and wherein the hole blocking layer is comprised of a metal oxide dispersed in a blend of a phenolic compound and a phenolic resin, or a blend of two phenolic resins wherein the first resin possesses a weight average molecular weight of from about 500 to about 2,000 and the second resin possesses a weight average molecular weight of from about 2,000 to about 20,000, and a dopant, for example, of silicon oxide present in an amount of, for example, from about 2 to about 15 weight percent; a photoconductive imaging member comprised of a supporting substrate, a hole blocking layer thereover, a photogenerating layer, and a charge transport layer, and wherein the hole blocking layer is comprised of a titanium oxide, a dopant, such as a silicon oxide, a phenolic compound or compounds containing at least two, preferably about 2 to about 10 phenolic groups, such as bisphenol S and/or a phenolic resin having a weight average molecular weight of from about 500 to about 2,000, and a known phenolic resin, reference for example U.S. Pat. No. 6,177,219, the disclosure of which is totally incorporated herein by reference; a photoconductive imaging member wherein the hole blocking layer is of a thickness of about 0.01 to about 30 microns, and more specifically is of a thickness of about 0.1 to about 8 microns; a photoconductive imaging member comprised in sequence of a supporting substrate, a hole blocking layer, a photogenerating layer and a charge transport layer; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging wherein the charge transport aryl amines are of the formula

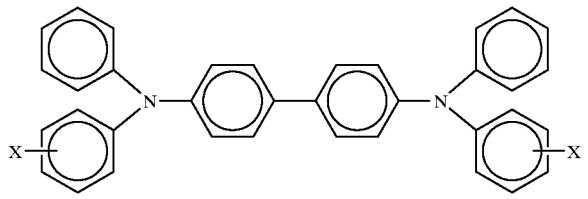

wherein X is selected from the group consisting of alkyl and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or a mixture thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; a photoconductive imaging member comprised of a supporting substrate, a hole blocking layer thereover, a photogenerating layer, and a charge transport layer, and wherein the hole blocking layer is generated from titanium oxide, such as titanium oxide or titanium dioxide, dispersed in a blend of a phenolic compound or compounds, and a phenolic resin, wherein the phenolic compound contains at least two phenolic groups, or a blend of two phenolic resins wherein one of the resins possesses a weight average molecular weight from about 500 to about 2,000, and the second resin possesses a weight average molecular weight of from about 2,000 to about 20,000, and a dopant; a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least 2, for example from 2 to 7, phenolic groups; a photoconductive imaging member comprised of a supporting substrate, a hole blocking layer thereover, a photogenerating layer, and a charge transport layer, and wherein the hole blocking layer is comprised of a metal oxide, and a mixture of at least two phenolic resins with dissimilar weight average molecular weights; an imaging member wherein the metal oxide is a titanium oxide; an imaging member wherein the metal oxide is a titanium oxide; an imaging member wherein at least two is two and wherein one of the phenolic resins possesses a lower weight average molecular weight than the second phenolic resin, and wherein lower is from about 1,000 to about 10,000; an imaging member wherein the weight average molecular weight of the low molecular weight phenolic resin is from about 500 to about 2,000; an imaging member wherein the phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl) methane; an imaging member wherein the phenolic compound is bisphenol M, 4,4'-(1,3-phenylenediisopropylidene)bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene)diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

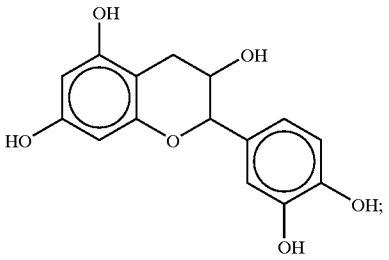

Catechin an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol; an imaging member wherein there is selected for the blocking layer about 4 to about 50 weight percent of a phenolic compound; an imaging member wherein the blocking layer comprises from about 1 to about 99 weight percent of a first phenolic resin and from about 99 to about 1 weight percent of a second phenolic resin, and wherein the total thereof is about 100 percent; an imaging member wherein the hole blocking layer is of a thickness of about 0.01 to about 30 microns; an imaging member wherein the hole blocking layer is of a thickness of from about 0.1 to about 8 microns; an imaging member comprised in the sequence of a supporting substrate, a hole blocking layer, an optional adhesive layer, a photogenerating layer, and a hole transport layer; an imaging member wherein the adhesive layer is comprised of a polyester with an $M_w$ of about 45,000 to about 75,000, and an $M_n$ of from about 30,000 about 40,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 0.05 to about 10 microns, and wherein the transport layer is of a thickness of from about 10 to about 50 microns; an imaging member wherein the photogenerating layer is comprised of photogenerating pigments dispersed in a resinous binder in an amount of from about 5 percent by weight to about 95 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components, and more specifically aryl amines, and which aryl amines are of the formula

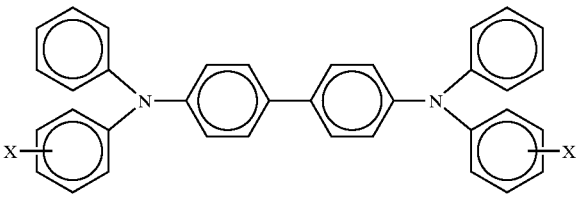

wherein X is selected from the group consisting of alkyl and halogen, and the like, and wherein the aryl amine is optionally dispersed in a resinous binder; an imaging member wherein alkyl contains from about 1 to about 10 carbon atoms; an imaging member wherein the aryl amine is N,N'-diphenyl-N,N-bis(3-methyl phenyl)-1,1'-biphenyl-4,4'-diamine; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper; a photoconductive imaging member comprised of a supporting substrate, a hole blocking layer, a photogenerating layer, and a charge transport layer, and wherein the hole blocking layer is comprised of a mixture of a metal oxide, a phenolic compound containing two phenolic groups, a phenolic resin and a dopant; a photoconductive imaging member wherein the phenolic compound is bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylenediisopropylidene) bisphenol), S (4,4'-sulfonyldiphenol), Z (4,4'-cyclohexylidenebisphenol), hexafluorobisphenol A (4,4'-(hexafluoroisopropylidene) diphenol), resorcinol, hydroxyquinone or catechin, and wherein the blocking layer is provided on an aluminum drum followed by heat curing at a temperature of, for example, from about 135° C. to about 185° C.; a photoconductive imaging member comprised of a supporting substrate, a hole blocking layer, a photogenerating layer, and a hole transport layer, and wherein the hole blocking layer is comprised of a metal oxide, a blend of two phenolic resins and a dopant; a photoconductive imaging member wherein the phenolic resin is comprised of a first resin that possesses a weight average molecular weight of from about 500 to about 2,000, and a second resin that possesses a weight average molecular weight of from about 2,500 to about 20,000, and wherein the blocking layer is provided on an aluminum drum followed by heat curing at a temperature of from about 135° C. to about 190° C.; an imaging member wherein the phenolic compound contains from about 2 to about 10 phenolic groups, or optionally a blend of two phenolic resins with dissimilar molecular weights; an imaging member wherein at least two is from about 2 to about 10; an imaging member wherein at least two is from about 2 to about 7; and an imaging member wherein at least two is two, and wherein the first phenolic resin has a weight average molecular weight of from about 3,000 to about 17,000, and the second phenolic resin has a weight average molecular weight of from about 700 to about 1,500; and an imaging member wherein the binder resins possess a weight average molecular weight of from about 500 to about 40,000.

The hole blocking or undercoat layers for the imaging members of the present invention contain a metal oxide like titanium, chromium, zinc, tin and the like, a mixture of phenolic compounds and a phenolic resin or a mixture of 2 phenolic resins, and optionally a dopant such as $SiO_2$. The phenolic compounds contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol; hydroxyquinone, catechin and the like.

The hole blocking layer is, for example, comprised of from about 20 weight percent to about 80 weight percent, more specifically, from about 55 weight percent to about 65 weight percent of a metal oxide, such as $TiO_2$, from about 20 weight percent to about 70 weight percent, more specifically, from about 25 weight percent to about 50 weight percent of a phenolic resin, from about 2 weight percent to about 20 weight percent, more specifically, from about 5 weight percent to about 15 weight percent of a phenolic compound preferably containing at least two phenolic groups, such as bisphenol S, and from about 2 weight percent to about 15 weight percent, more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene)bisphenol, such as VARCUM™ 29108 and 29116 (OxyChem Company), formaldehyde polymers with cresol and phenol, such as VARCUM™ 29457 (OxyChem Company), DURITE™ T SD-42° A., SD-422A (Borden Chemical), or formaldehyde polymers with phenol and p-tert-butylphenol, such as DURITE™ ESD 556C (Border Chemical).

Illustrative examples of substrate layers selected for the imaging members of the present invention, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally is of a thickness of from about 5 microns to about 75 microns, and more specifically, of a thickness of from about 10 microns to about 40 microns, include molecules of the following formula

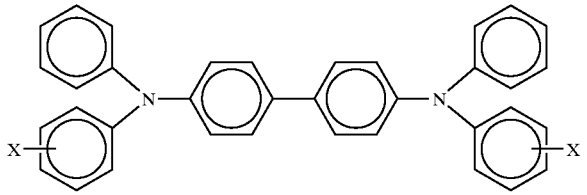

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ about 3,600, viscosity about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer and there was obtained a median $TiO_2$ particle size of 50 nanometers in diameter and a $TiO_2$ particle surface area of 30 $m^2$/gram with reference to the above $TiO_2$/VARCUM dispersion. Additional solvents of 5 grams of 1-butanol, and 5 grams of xylene; 2.6 grams of bisphenol S (4,4'-sulfonyldiphenol), and 5.4 grams of the above prepared $SiO_2$/VARCUM slurry were added to 50 grams of the above resulting titanium dioxide/VARCUM dispersion, referred to as the coating dispersion. An 84 millimeters in diameter and 355 millimeters in length aluminum pipe, cleaned with detergent and rinsed with deionized water was dip coated with the coating dispersion at a pull rate of 160 millimeters/minute, and subsequently, dried at 160° C. for 15 minutes, which resulted in an undercoat layer (UCL) comprised of $TiO_2/SiO_2$/VARCUM/bisphenol S with a weight ratio of about 52.7/3.6/34.5/9.2 and a thickness of 3.5 microns. Additional similar devices with the UCL thicknesses at 2.5 and 5 microns were also fabricated by repeating the above process.

A 0.5 micron thick photogenerating layer was subsequently coated on top of the above generated undercoat layer from a dispersion of Type V hydroxygallium phthalocyanine (2.4 grams), alkylhydroxy gallium phthalocyanine (0.6 gram), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (2 grams), in 95 grams of n-butylacetate. Subsequently, a 24 $\mu$m charge transport layer (CTL) was coated on top of the photogenerating layer from a solution of N,N'-diphenyl-N,N-bis(3-methylphenyl)-1,1'-biphenyl-4,4'-diamine (8.8 grams) and a polycarbonate, PCZ-400 [poly(4,4'-dihydroxydiphenyl-1-1-cyclohexane, $M_w$=40,000)] available from Mitsubishi Gas Chemical Company, Ltd. (13.2 grams) in a mixture of 55 grams of tetrahydrofuran (THF) and 23.5 grams of toluene. The CTL was dried at 120° C. for 45 minutes. A device with a 4-micron hole blocking layer comprised of a titanium dioxide, $SiO_2$, VARCUM dispersion without bisphenol S was also fabricated in accordance with the above process.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristics curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. The following table summarizes the electrical performance for these devices.

| Device | $V_{low}$ of 4.5 erg/cm$^2$ Exposure Energy and 63 ms Charge to Exposure Delay (V) | $V_{low}$ of 4.5 erg/cm$^2$ Exposure Energy and 210 ms Charge to Exposure Delay (V) | dV/dx | $V_{depletion}$ (V) |
|---|---|---|---|---|
| No Bisphenol, 4 μm | 110 | 72 | 260 | 65 |
| 2.5 μm | 66 | 32 | 270 | 90 |
| 3.5 μm | 76 | 39 | 265 | 95 |
| 5.0 μm | 90 | 49 | 261 | 98 |

$V_{low}$ is the surface potential of the device subsequent to a certain light exposure at a certain time delay after the exposure, dV/dx is the initial slope of the PIDC curve and is a measurement of sensitivity, and $V_{depletion}$ is linearly extrapolated from the surface potential versus charge density relation of the device and is a measurement of voltage leak during charging. $V_{low}$ is lower for the invention devices shown compared with the no bisphenol device with the same hole blocking layer thickness. Other electrical characteristics such as dV/dx and $V_{depletion}$ remain substantially unchanged.

It is generally known that a $V_{low}$ reduction is generated from the improved electron transport and electron injection in hole blocking layer. With the hole blocking layers containing the phenolic compounds or a low molecular weight phenolic resin as illustrated herein, the resulting phenolic network becomes more flexible after cure, which can facilitate electron transport of the metal oxide within and enable a reduction in $V_{low}$.

Other embodiments and modifications of the present invention may occur to those of ordinary skill in the art subsequent to a review of the information presented herein; these embodiments, modifications, equivalents thereof, substantial equivalents thereof, or similar equivalents thereof are also included within the scope of this invention.

What is claimed is:

1. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is 4,4'-sulfonyldiphenol.

2. An imaging member in accordance with claim 1 wherein said metal oxide is a titanium oxide.

3. An imaging member in accordance with claim 1 wherein said phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol.

4. An imaging member in accordance with claim 3 wherein said resin possesses a weight average molecular weight of from about 500 to about 40,000.

5. An imaging member in accordance with claim 1 wherein there is present from about 96 to about 50 weight percent of the phenolic resin.

6. An imaging member in accordance with claim 1 wherein said hole blocking layer is of a thickness of about 0.01 to about 30 microns.

7. An imaging member in accordance with claim 1 wherein said hole blocking layer is of a thickness of from about 0.1 to about 8 microns.

8. An imaging member in accordance with claim 1 further containing a supporting substrate comprised of a conductive metal substrate of aluminum, aluminized polyethylene terephthalate or titanized polyethylene terephthalate.

9. An imaging member in accordance with claim 1 wherein said photogenerating layer is of a thickness of from about 0.05 to about 10 microns, and wherein said transport layer is of a thickness of from about 10 to about 50 microns.

10. An imaging member in accordance with claim 1 wherein the photogenerating layer is comprised of a photogenerating pigment or photogenerating pigments dispersed in a resinous binder, and wherein said pigment or pigments are present in an amount of from about 5 percent by weight to about 95 percent by weight, and wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals.

11. An imaging member in accordance with claim 1 wherein the charge transport layer comprises aryl amines, and which aryl amines are of the formula

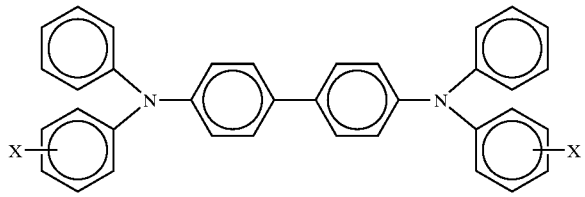

wherein X is selected from the group consisting of alkyl and halogen.

12. An imaging member in accordance with claim 11 wherein alkyl contains from about 1 to about 10 carbon atoms.

13. An imaging member in accordance with claim 11 wherein the aryl amine is N,N'-diphenyl-N,N-bis(3-methyl phenyl)-1,1'-biphenyl-4,4'-diamine.

14. An imaging member in accordance with claim 11 wherein said blocking layer is cured by heating subsequent to it being deposited on said supporting substrate.

15. An imaging member in accordance with claim 1 wherein the photogenerating layer is comprised of metal phthalocyanines, or metal free phthalocyanines.

16. An imaging member in accordance with claim 1 wherein the photogenerating layer is comprised of titanyl phthalocyanines, perylenes, or hydroxygallium phthalocyanines.

17. An imaging member in accordance with claim 1 wherein the photogenerating layer is comprised of Type V hydroxygallium phthalocyanine.

18. A method of imaging which comprises generating an electrostatic latent image on the imaging member of claim 1, developing the latent image, and transferring the developed electrostatic image to a suitable substrate.

19. An imaging member in accordance with claim 1 wherein said blocking layer is cured by heating subsequent to it being deposited on a supporting substrate.

20. An imaging member in accordance with claim 19 wherein said substrate is aluminum and said curing is at a temperature of from about 135° C. to about 195° C.

21. A photoconductive imaging member in accordance with claim 1 wherein said blocking layer include a dopant component.

22. A photoconductive imaging member in accordance with claim 21 wherein said dopant is a silicon oxide.

23. A photoconductive imaging member comprised in sequence of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is 4,4'-isopropylidenediphenol.

24. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is 4,4'-ethylidenebisphenol.

25. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is bis(4-hydroxyphenyl)methane.

26. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is selected from the group consisting of 4,4'-(1,3-phenylenediisopropylidene) bisphenol, 4,4'-(1,4-phenylenediisopropylidene) bisphenol, 4,4'-cyclohexylidene bisphenol, 4,4'-(hexafluoroisopropylidene) diphenol, 1,3-benzenediol, and 1,4-benzenediol, and 1,4-benzenediol.

27. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups, and wherein said phenolic compound is of the formula:

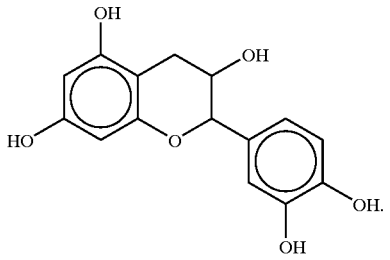

Catechin

28. A photoconductive imaging member comprised of a supporting substrate, a hole blocking layer, a photogenerating layer, and a charge transport layer, and wherein the hole blocking layer is comprised of a mixture of a metal oxide, and a phenolic compound and a phenolic resin, and wherein said phenolic compound is bisphenol A (4,4'-isopropylidenediphenol), bisphenol E (4,4'-ethylidenebisphenol), bisphenol F (bis(4-hydroxyphenyl) methane), bisphenol M (4,4'-(1,3-phenylenediisopropylidene) bisphenol), bisphenol P (4,4'-(1,4-phenylenediisopropylidene) bisphenol), bisphenol S (4,4'-sulfonyldiphenol), bisphenol Z (4,4'-cyclohexylidenebisphenol), hexafluorobisphenol A (4,4'-(hexafluoroisopropylidene) diphenol), resorcinol, hydroxyquinone or catechin, and wherein said blocking layer is provided on an aluminum drum followed by heat curing said member at a temperature of from about 135° C. to about 185° C.

29. An imaging member in accordance with claim 28 wherein said mixture is comprised of about 2 to about 7 phenolic compounds.

30. A photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups wherein said phenolic compound is 4,4'-sulfonyldiphenol, 4,4'-isopropylidenediphenol, 4,4'-ethylidenebisphenol, bis(4-hydroxyphenyl)methane, 4,4'-(1,3-phenylenediisopropylidene) bisphenol, 4,4-(1,4-phenylenediisopropylidene)bisphenol, 4,4'-cyclohexylidenebisphenol, 4,4'-(hexafluoroisopropylidene) diphenol, 1,3-benzenediol, 1,4-benzenediol, or of the formula

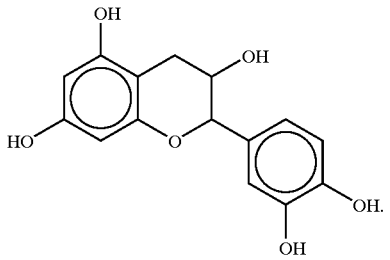

Catechin

* * * * *